US005795176A

United States Patent [19]

Blaetz

[11] Patent Number: 5,795,176

[45] Date of Patent: Aug. 18, 1998

[54] METHOD OF PROTECTING AN ELECTRICAL CONNECTION AND PLUG LOCK THEREFOR

[76] Inventor: Ewald Blaetz, 442 W. Ames Rd., Canajoharie, N.Y. 13317

[21] Appl. No.: 696,724

[22] Filed: Aug. 14, 1996

[51] Int. Cl.[6] ..... H01R 13/62

[52] U.S. Cl. ..... 439/373; 439/275

[58] Field of Search ..... 439/373, 371, 439/312, 314, 320, 271, 274, 275, 462, 589, 587

[56] References Cited

U.S. PATENT DOCUMENTS

| | | | |
|---|---|---|---|
| 2,458,153 | 1/1949 | Festge . | |
| 2,716,225 | 8/1955 | McCubbin | 439/314 |
| 2,963,536 | 12/1960 | Kokalas . | |
| 3,251,020 | 5/1966 | Coleman . | |
| 3,430,187 | 2/1969 | De Man et al. . | |
| 3,775,729 | 11/1973 | Casper . | |
| 4,531,800 | 7/1985 | Avener | 439/373 |
| 4,611,872 | 9/1986 | Ito et al. . | |
| 4,789,353 | 12/1988 | Busta et al. . | |
| 5,067,907 | 11/1991 | Shoteg | 439/373 |
| 5,080,598 | 1/1992 | Shotey . | |
| 5,098,310 | 3/1992 | Avramovic et al. . | |
| 5,158,479 | 10/1992 | Mouissie . | |
| 5,183,413 | 2/1993 | Lazaro, Jr. et al. . | |
| 5,299,951 | 4/1994 | Blaetz . | |
| 5,306,195 | 4/1994 | Hayashi . | |
| 5,344,333 | 9/1994 | Haag | 439/320 |
| 5,401,184 | 3/1995 | Sundstrom et al. | 439/373 |

FOREIGN PATENT DOCUMENTS

| | | |
|---|---|---|
| 0 289 014 | 4/1988 | European Pat. Off. . |
| 2 006 083 | 2/1970 | Germany . |
| 674 600 A5 | 12/1978 | Germany . |
| 1 569 363 | 3/1977 | United Kingdom . |

*Primary Examiner*—Neil Abrams
*Assistant Examiner*—Yong Ki Kim
*Attorney, Agent, or Firm*—Schmeiser, Olsen & Watts

[57] ABSTRACT

The present invention is an apparatus and method for providing a retrofitable cover on a preexisting plug which includes a lock on or quick release type connection. The retrofitable cover provides environment proof protection to an electrical connection between an extension cord and an electrical outlet box. The cover includes a hollow tubular housing and a hollow tubular end cap. As the end cap is tightened onto the hollow tubular housing, the housing contacts and compresses a bushing in the end cap to create a leak-free sealing of the interior of the housing. Another embodiment of the present invention is an extension cord which provides power to a plurality of receptacles which have the lock on and quick release connection feature.

14 Claims, 5 Drawing Sheets

METHOD OF PROTECTING AN ELECTRICAL CONNECTION AND PLUG LOCK THEREFOR

BACKGROUND OF THE INVENTION

1. Technical Field

The present invention relates to the field of environment proof electrical connection assemblies. More specifically, the invention is a retrofitable housing assembly designed to cover and protect the electrical connection between an extension cord and an electrical outlet box. Alternatively, the invention is a retrofitable housing assembly designed to cover and protect the electrical connection between a multi-plug extension cord and the extension cords which are connected thereto.

2. Background Art

Electrical receptacles are often located outdoors to provide a source of electrical power. The outdoor environment subjects the electrical outlets to foreign contaminants such as water, dust, etc. When an electrical plug is plugged into the outlet, a danger is presented to users of electrical outlets from these substances that may create an electrical hazard.

U.S. Pat. No. 5,299,951 issued to Blaetz on Apr. 5, 1994, discloses a solution to the problem of electrical cords which connect at different points throughout a commercial or residential site and can be damaged or disconnected. However, the problem of environment proof connections to a receptacle or the situation when more than one user wants to be connected to the electrical power supply is not addressed.

U.S. Pat. No. 5,401,184 issued to Sundstrom et al. on Mar. 28, 1995, and assigned to Lynx Enterprises discloses a waterproof connection between a plug and a receptacle. However, the rolling of the seat over the plug is a cumbersome method and it is not easy to disconnect and reconnect and further is not protected from physical shock.

U.S. Pat. No. 5,080;598 issued to Shotey on Jan. 14, 1992, discloses a waterproof sheath which covers a plug and a faceplate connection. The waterproof sheath is drawn tight by a string which does not provide a simple quick connect and disconnect feature and also does not protect the connection against physical shock.

The aforementioned art is hereby incorporated by reference.

SUMMARY OF THE INVENTION

Disclosed is an apparatus and method for providing a retrofitable cover on a preexisting plug which includes a release type connection. The retrofitable housing assembly provides environment proof and shockproof protection to an electrical connection between an extension cord and an electrical outlet box. The housing assembly includes a hollow tubular housing and a hollow tubular end cap. As the end cap is tightened onto the hollow tubular housing, the housing contacts and compresses a bushing in the end cap to create a leak-free sealing of the interior of the hollow tubular housing. Thus, under this apparatus and method an environment proof connection can be made between a power cord and an electrical receptacle which is easy to connect and disconnect.

It is therefore an advantage of the present invention to provide a lightweight, strong, extremely durable, easy to assemble and inexpensive to manufacture plug cover.

It is a further advantage of the present invention to provide a housing for an electrical connection between an electrical outlet box receptacle that will prevent moisture, dirt, harmful gases, or other contaminants from contacting the connection.

It is a further advantage of the present invention to provide a housing for an electrical connection that can be adapted to fit different sizes of power cords.

It is a further advantage of the present invention to provide a quick-release coupling for the release coupling.

It is a further advantage of the present invention to provide a lock on coupling for the release coupling.

It is an advantage of another embodiment of the present invention to provide an extension cord which provides power to a plurality of receptacles which each have the lock on or quick release connection feature.

It is therefore an advantage of the other embodiment to provide an environment proof power connection for multiple users from one power cord.

It is a further advantage of the second embodiment to provide multiple users with a reliable and retrofitable connect and disconnect from a power source.

BRIEF DESCRIPTION OF THE DRAWINGS

These and other advantages of the present invention will become more readily apparent upon reading the following detailed description and upon reference to the following drawings in which.

DESCRIPTION OF THE PREFERRED EMBODIMENTS

Figure 1:
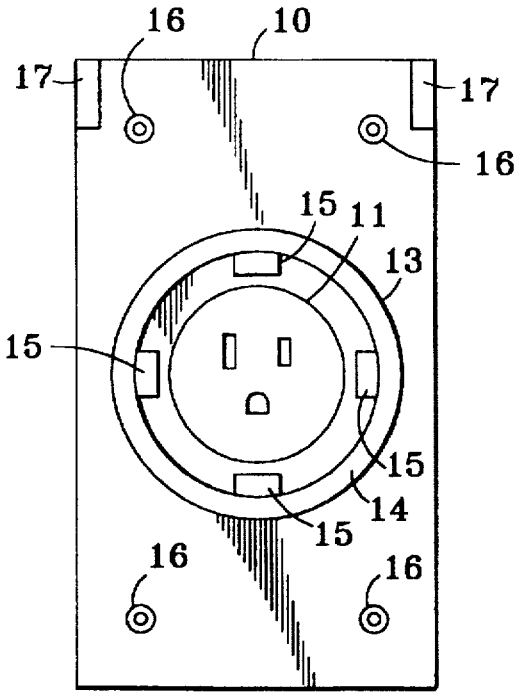
FIG. 1 discloses a front view of a face plate with a quick-release and lock on feature.

Referring now to the drawings in greater detail, wherein like reference characters refer to like parts throughout the several figures.

Figure 2:
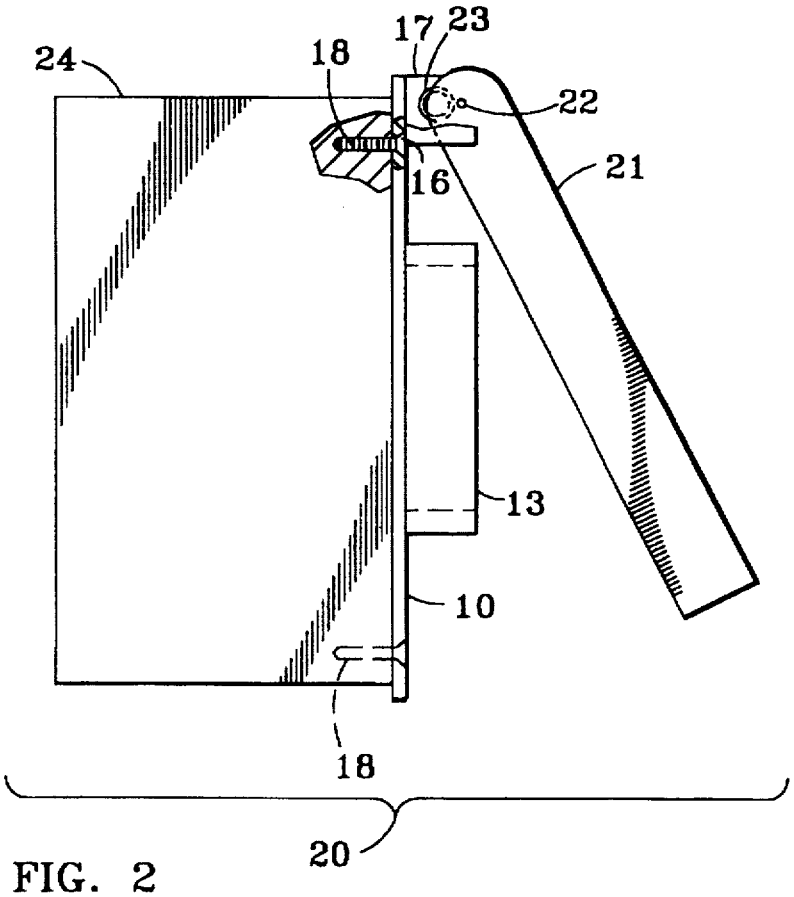
FIG. 2 discloses a side view of an electric outlet box assembly which includes an electrical outlet box with a faceplate attached.

FIGS. 1 and 2 disclose a front view and a side view of a face plate 10 mounted to an electrical outlet box 24. The face plate 10 surrounds a release type connection and an electrical outlet receptacle 11. The release type connection is both a quick-release and a lock on type connection. The connection has the quick-release feature so that it can be rapidly connected and disconnected. The connection also has a lock on feature so that it can be reliably and securely attached and not be disconnected accidentally. The quick-release and lock on type connection includes a circular protruding portion 13, projections 15, and a shaped surface 14 used to seat a gasket. FIG. 1 further discloses an engaging device 17 upon which a lid can be attached. The face plate 10 can be a metal material such as steel or aluminum or a plastic material such as polycarbonate thermoplastic. The electrical outlet box assembly 20 includes face plate 10 attached to an electrical outlet box 24. The electrical outlet box 24 can also be made of a metal material such as steel or aluminum or a plastic material such as polycarbonate thermoplastic. The face plate 10 is attached to the electrical outlet box 24 by through screw holes 16 by screws 18. The lid 21 can be moved from a closed position when a plug is not attached to the receptacle 11 to an open position when the plug is attached. The lid 21 is attached to the face plate 10 by the engaging device 17. Two pins (one pin 22 is shown in FIG. 2) on each end of the lid 21 are used to hold the lid 21 to the engaging device 17: A biasing device 23 such as a spring forces the lid 21 into the closed position when the plug is not present. The lid 21 covers the receptacle 11 to prevent an exposed electrical source.

Figure 3:
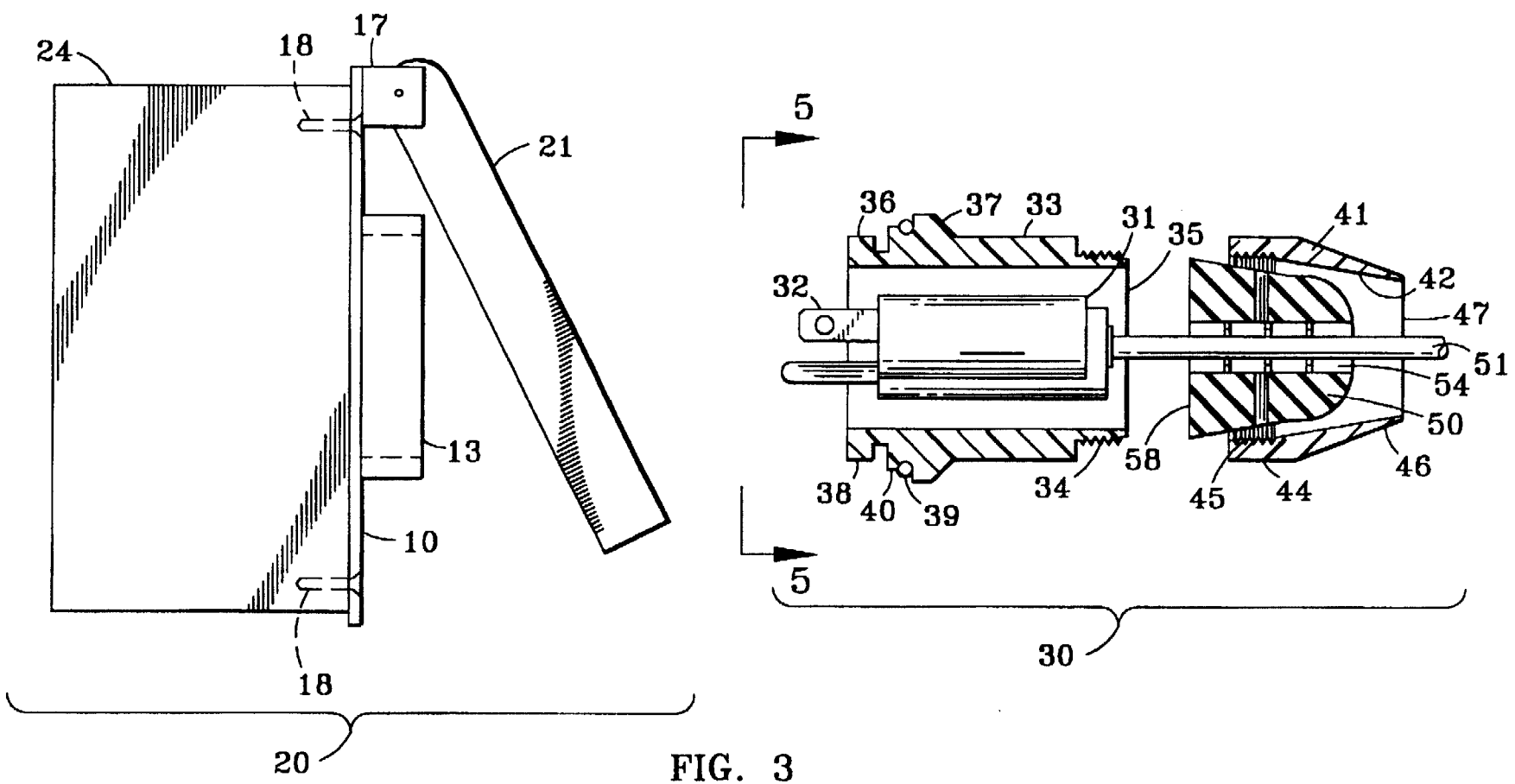
FIG. 3 shows a cross-sectional view of the preferred embodiment of the present invention which includes a disconnected plug housing assembly and the electrical outlet box assembly.

FIG. 3 discloses a cross-sectional view of the present invention which includes the plug housing assembly 30 and the electrical outlet box assembly 20. The plug housing assembly 30 includes a plug 31 with prongs 32 which connect to the outlet receptacle 11. The plug housing assembly 30 is composed of a hollow tubular housing 33 with exterior threads 34 on its distal end 35. The hollow tubular housing 33 is typically one to three inches in diameter and approxinmately two to four inches in length.

Figure 4:
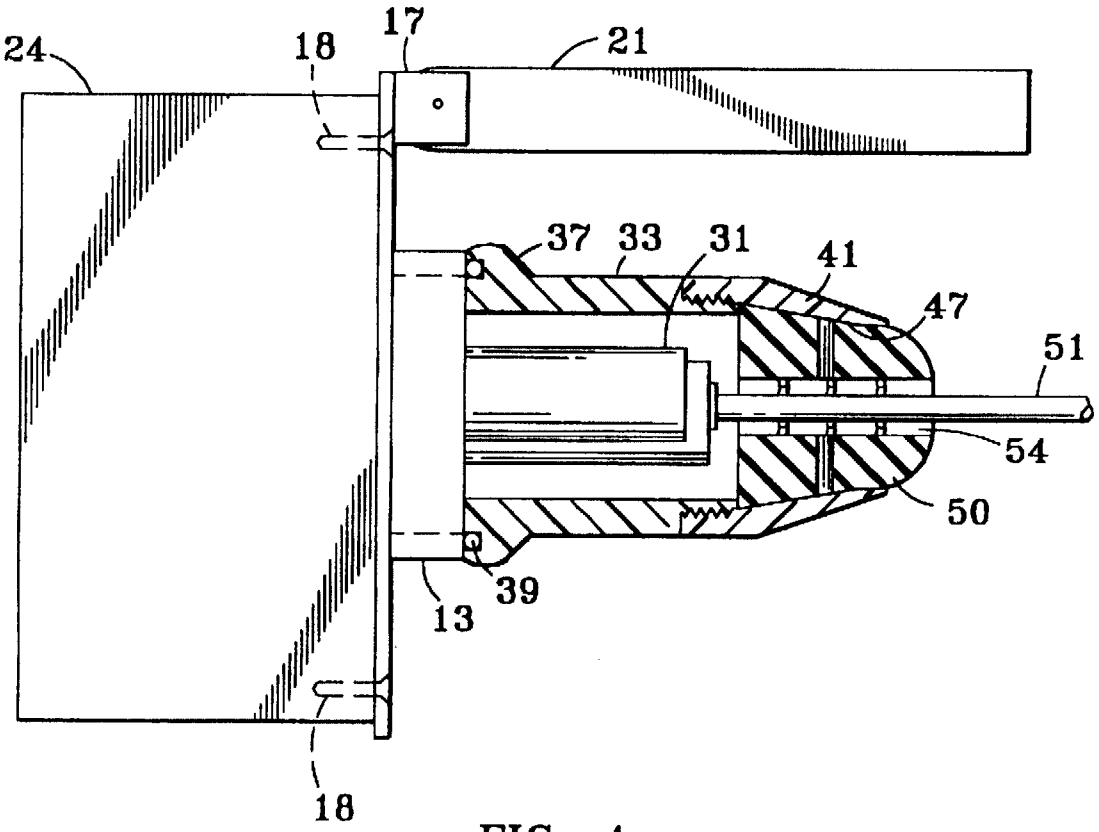
FIG. 4 shows the plug housing assembly connected to the electrical outlet box assembly.
Figure 5:
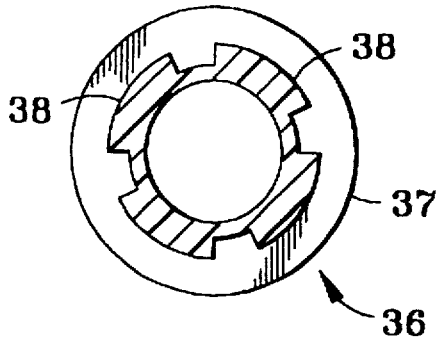
FIG. 5 is a view partly in cross-section taken on the plane indicated by line 5—5 of FIG. 3 and looking in the direction of the arrows.
Figure 6:
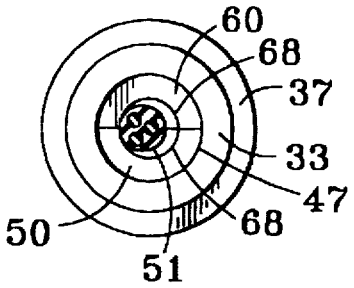
FIG. 6 provides an end view of the plug housing assembly as shown in FIG. 4.

The electrical outlet box assembly 20 is joined to the plug housing assembly 30 at the release connections 15 and 36. The connection is made by joining end 37 with the protruding portion 13 and then twisting the two portions relative to each other. The twisting motion causes inwardly extending projections 15 on the protruding portion 13 to become lodged behind outwardly extending projections 38 on end 37. FIG. 4 shows the connection once the two portions have been twisted and therefore are in locked engagement. A gasket or "O"-ring 39 is also included in the connection where it is compressed between the outer surface 40 of end 37 and a shaped surface 14 of the protruding portion 13 to seal the connection against the environment.

Attached to the distal end 35 of the hollow tubular housing 33 is a tubular end cap 41 having an interior wall 42 that encircles a thru-bore 54. The end cap 41 has a cylindrical forward portion 44 that has interior threads 45 that mate with the threads 34 of the hollow tubular housing 33. The distal portion 46 of the end cap 41 is frustoconical in shape and has a large aperture 47 located at the extreme end of the tubular end cap 41. The aperture is concentric with the end cap's longitudinal axis.

Figure 7:
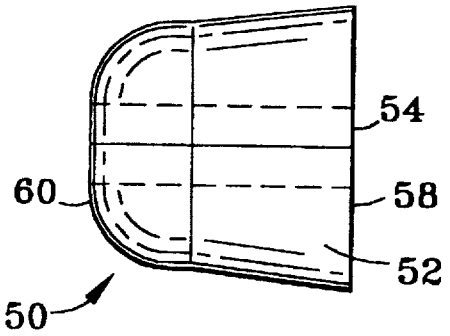
FIG. 7 is a side view of the bushing shown in FIG. 3.
Figure 8:
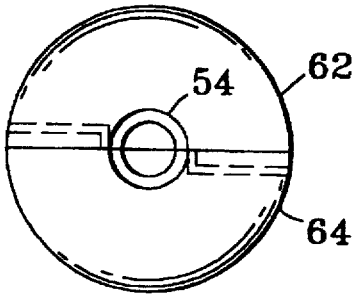
FIG. 8 is an end view of the bushing shown in FIG. 7.

A two-piece bushing 50 is located within the hollow tubular end cap 41 and has the function of sealing the ends of the hollow tubular housing 33 against the entry of dirt, moisture, or other contaminants. FIGS. 7 and 8 provide detailed views of the bushing. The forward portion 52 of the bushing 50 is frustoconical in shape and therefore is complementary to the interior of the hollow tubular end cap 41. Extending through the longitudinal center axis of the bushing is a thru-bore 54 through which a power cord such as 51 may pass. The outer diameter of the bushing's front face 58 is approximately equal to the outer diameter of the distal portion of end 35 of the hollow tubular housing 33. As shown in FIG. 4 when the bushing 50 is located within the hollow tubular end cap 41 and the end cap is secured to hollow tubular housing 33, the front face 58 of the bushing 50 is contacted by end 35 of the hollow tubular housing 33. This causes the bushing 50 to be compressed within the end cap 41 and the distal end 60 of the bushing 50 to extend outwardly through aperture 47 in the end cap 41. As the bushing is compressed, the diameter of the bushing thru-bore 54 is reduced and the bushing 50 snugly contacts the power cord 51.

Figure 9:
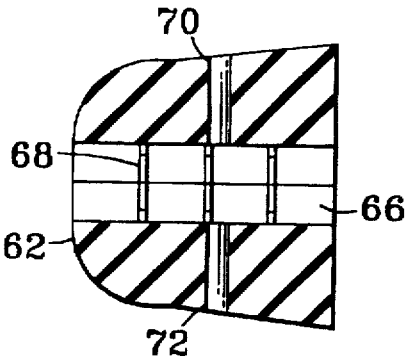
FIG. 9 is a plan view of a bushing half.
Figure 10:
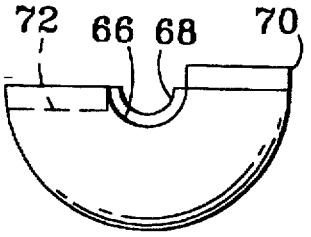
FIG. 10 is an end view of the bushing half shown in FIG. 9.

The bushing 50 is made up of two substantially identical halves 62 and 64 that include complementary interlocking structures. In FIGS. 9 and 10, one of the halves is detailed. As can be seen, each bushing half has a central main groove 66 that forms one-half of thru-bore 54 when the bushing halves are mated. The central main groove 66 includes a plurality of semi-circular ridges or fingers 68 that are perpendicular or angled relative to the longitudinal axis of the main groove 66.

The ridges 68 are preferably somewhat flexible so that when the bushing 50 is placed around the power cord 51, the ridges 68 contact the surface of the power cord 51 to prevent any leakage from occurring through the thru-bore 54 of the bushing. It should be noted that the use of flexible ridges and or ridges that are angled enables extension cords of different diameters to be received within bore 54 with the bushing still being capable of preventing leakage through the thru-bore 54. When extension cords of significantly different diameters are used, other bushings having reduced or over-sized thru-bores may be substituted.

Located adjacent to main groove 66 is an outwardly extending member 70 that is oriented perpendicularly to the longitudinal axis of the groove. Located on the opposite side of the bushing and also adjacent the main groove 66 is a slot or recess 72 that is complementary in shape to member 70. The recess also extends perpendicularly to the longitudinal axis of the main groove 66.

When the two bushing halves are joined, the bushing projections 70 within the bushing recesses 72 (shown in FIG. 8) form a tongue and groove locking structure that prevents relative sliding movement between the two bushing halves. It should also be noted that the structure and orientation for the tongue and grooves acts to prevent the formation of any leak paths through the bushing 50 when the halves are joined.

To install the plug housing assembly 30 over the coupling area between the extension cord 51 and the electrical receptacle 11, the power cord 51 must initially be separated from the electrical receptacle 11. The user first places the hollow end cap 41 over the end of cord 51 and slides it back on the cord. Next, the user attaches the bushing 50 by joining together the bushing pair 62, 64 over the cord 51 proximate the plug 35. The hollow tubular end cap 41 is then gently pulled over the bushing 50.

The hollow tubular housing 33 and the hollow tubular end cap 41 are initially separated and the user then attaches them together via the mating of threads 45 and 34. The end cap 41 is not tightened against the hollow tubular housing 33 at this point. The user then joins the extension cord plug 31 and the electrical outlet receptacle 11 together by inserting the plug into the socket 11. Next, the plug assembly housing 30 and the electrical outlet box assembly 20 are mated via release connection 13 and 36.

The assembly now resembles the assembly shown in FIG. 4. The user then tightens the end cap 41 onto the hollow tubular housing 33. As the end cap moves further onto the hollow tubular housing 33, the distal end 35 of the hollow tubular housing 33 contacts the front face 58 of the bushing. This causes the bushing to be compressed and tightly fit the interior of the hollow tubular end cap 33 as well as to tighten down on the power cord 51 that extends through the center of the bushing 50. This effectively seals the interior of the hollow tubular housing 33 against the entry of dirt, moisture, harmful gases, or other contaminants. The pair of bushings 62, 64 are sized so that when the end cap 41 is fully threaded onto the hollow tubular housing 33, the bushings are compressed the necessary amount to achieve proper sealing of the hollow tubular housing 33.

To remove the plug housing assembly 30, one reverses the above steps. It should be noted that if the user needs to quickly disconnect the power cord from the receptacle, all that is required is to rotate the hollow tubular housing 33 relative to the protruding portion 13. This causes the separation of the plug assembly housing from the electrical outlet box assembly 20 and the plug 31 can then be removed from the socket 11. If the connection between the power cord and receptacle is made with some slack cord within the hollow tubular housing 33, the user will be able to quickly and easily reconnect the extension cord 51 to the receptacle without having to make any adjustment to the end cap.

Figure 11:
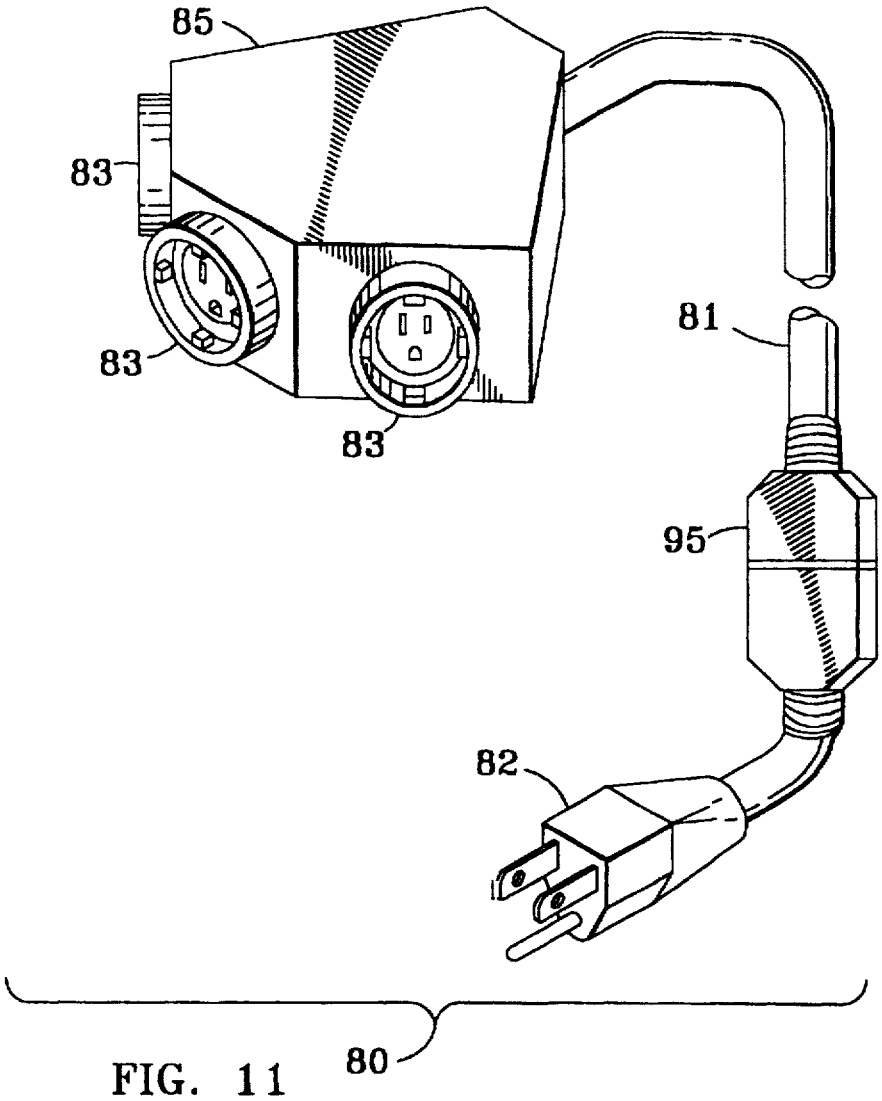
FIG. 11 discloses an alternative embodiment showing a plurality of receptacles with the quick-release and lock on features.
Figure 12:
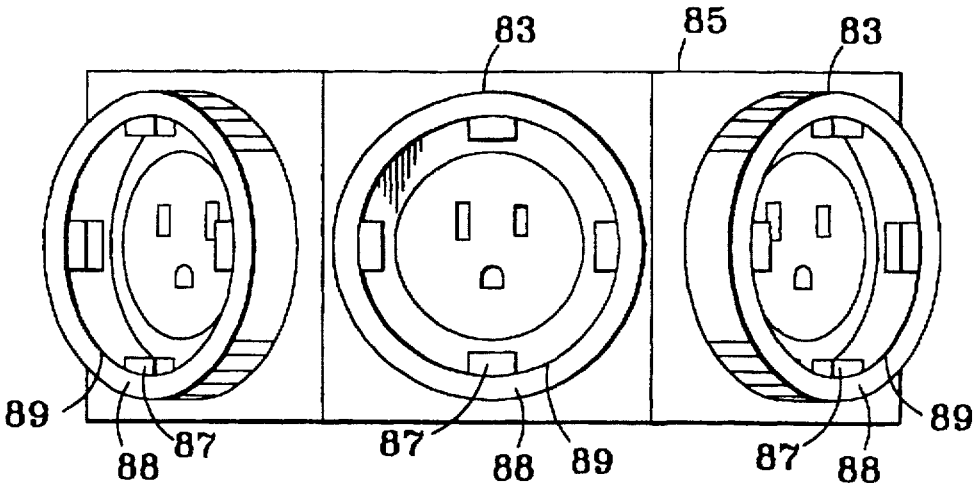
FIG. 12 discloses a front view of the alternative embodiment.

Figs. 11 and 12 disclose an alternative embodiment 80 of the present invention. FIG. 11 shows an electrical extension cord 81 with a male plug 82 connected to one end. At the other end are a plurality of receptacles 83 which branch out from the electrical extension cord 81. The receptacles are encased in a plastic housing 85. Three receptacles are shown in FIG. 11, but this number may be greater or lesser depending on the application. The receptacles 83 feature the quick-release and lock on connection previously discussed. The release connection includes the circular protruding portion 88, the projections 87, and the shaped surface for the gasket 89. The female electrical plug receptacles 83 engage male electrical plug members (not shown) so that more than one user can be connected to the electrical power supply. A ground fault circuit interrupter (GFCI) 95 is also shown in FIG. 11. The GFCI is a fast acting electronic circuit breaker that disconnects equipment from the power line to prevent electric shock or other damage when the safety ground connection is broken.

Although the present invention has been described above in specific terms, the description should be regarded as illustrative rather than limitative. Thus, workers of ordinary skill in the art will appreciate that the invention may be otherwise practiced, but that such alternative modes are encompassed by the terms of the following claims and equivalents thereto.

I claim:

1. A method comprising the steps of:

a) placing a hollow tubular end cap over a power cord and sliding the hollow tubular end cap over the power cord;

b) joining a pair of bushing halves together around the power cord and pulling the hollow tubular end cap over the bushing halves;

c) attaching the hollow tubular end cap to a first end of a hollow tubular housing by a connecting device;

d) tightening the hollow tubular end cap on the hollow tubular housing to compress the bushing halves and form a tight seal around the power cord;

e) providing the hollow tubular housing with a seal in a second end thereof, the second end also including outwardly extending projections;

f) providing a faceplate for an electrical socket, the faceplate including a planar member having an opening for the electrical socket and an integral circular protruding portion having radially inward extending projections;

g) joining a power cord plug and the electrical socket together by inserting the power cord plug into the electrical socket; and h) coupling the hollow tubular housing and the integral circular protruding portion together by interlocking the radially inward extending projections and the outwardly extending projections to compress the seal and form a tight seal.

2. An assembly comprising:

a housing having:

a faceplate with at least one integral, lock-on, quick release coupling having a continuous circular raised portion extending from the faceplate and projections extending from the raised portion, and at least one electrical socket encircled by the quick release coupling; and a plug protector having:

a rigid hollow tubular housing having a lock-on, quick release coupling with recessed portions for receiving the projections, and a gasket formed in a first end thereof, a hollow tubular end cap attached to the hollow tubular housing, a compressible bushing having a central throughbore and located in the hollow tubular end cap, and a connecting device for connecting a cylindrical portion of the hollow tubular end cap to a second end of the hollow tubular housing wherein as the connecting device is tightened the bushing is compressed; and wherein the faceplate and the hollow tubular housing join together at the quick release couplings to compress the gasket to form a tight seal.

3. The assembly of claim 2, further including a lid attached to the faceplate by an engaging device so that the lid moves between a first position covering the electrical socket to a second position exposing the electrical socket.

4. The assembly of claim 2, wherein the size of the central throughbore is variable depending on the size of a power cord to be inserted therethrough.

5. The assembly of claim 2, wherein the interior of the hollow tubular end cap is at least partially frustoconical in shape and the exterior of the bushing is at least partially frustoconical in shape so that when the bushing is compressed, the at least partially frustoconical shaped exterior of the bushing is pushed into contact with the at least partially frustoconical shaped interior of the hollow tubular end cap.

6. The assembly of claim 2, wherein the connecting device comprises interior threads located on the hollow tubular end cap and complementary exterior threads located on the hollow tubular housing.

7. The assembly of claim 2, wherein the cylindrical portion of the hollow tubular end cap is of a first outer diameter and the second end of the hollow tubular housing is of a second lesser outer diameter whereby when the connecting device tightens the hollow tubular end cap onto the hollow tubular housing, the second end of the hollow tubular housing compresses the bushing within the hollow tubular end cap.

8. The assembly of claim 2, wherein the compressible bushing comprises a first bushing half and a second bushing half and wherein each of the bushing halves includes a complementary registration device that mate when the first and second bushing half are brought together.

9. The assembly of claim 8, wherein the complementary registration device comprises tongue and groove structures located on each said first bushing half and second bushing half.

10. The assembly of claim 8, wherein each said first bushing half and second bushing half include a central main groove and when the first and second bushing half are joined, the central main groove in each said first bushing half and second bushing half forms the bushing central through-bore.

11. The assembly of claim 10, wherein the central main groove in each said first bushing half and second bushing half includes at least one ridge device oriented at an angle relative to a longitudinal axis of the central main groove.

12. The assembly of claim 2, wherein the housing is provided at an end of an extension cord.

13. The assembly of claim 12, wherein the extension cord includes a male plug at an opposite end to the housing.

14. The assembly of claim 12, wherein the extension cord includes a ground fault circuit interrupter (GFCI).

* * * * *